United States Patent [19]

Aslund

[11] Patent Number: 4,923,671

[45] Date of Patent: May 8, 1990

[54] METHOD OF PRODUCING POWDER-METALLURGICAL OBJECTS, SPECIFICALLY ELONGATE OBJECTS SUCH AS RODS, SECTIONS, TUBES OR THE LIKE

[76] Inventor: Christer Aslund, Bruksgrand 14, S-64 400 Torshalla, Sweden

[21] Appl. No.: 308,048

[22] Filed: Feb. 6, 1989

[30] Foreign Application Priority Data

Feb. 5, 1988 [SE] Sweden ..... 8800366
Feb. 5, 1988 [SE] Sweden ..... 8800365

[51] Int. Cl.[5] ..... B22F 7/06

[52] U.S. Cl. ..... 419/8; 419/23; 419/25; 419/28; 419/29; 419/39; 419/42; 419/53

[58] Field of Search ..... 419/8, 25, 26, 28, 29, 419/38, 41, 42, 23, 39, 53

[56] References Cited

U.S. PATENT DOCUMENTS

| | | | |
|---|---|---|---|
| 4,050,143 | 9/1977 | Aslund | 29/420 |
| 4,388,054 | 6/1983 | Larsson | 419/32 |
| 4,401,723 | 8/1983 | Aslund et al. | 428/554 |
| 4,427,626 | 1/1984 | Petrov et al. | 419/28 |
| 4,460,541 | 7/1984 | Singleton et al. | 419/42 |
| 4,710,345 | 12/1987 | Doi et al. | 419/28 |

*Primary Examiner*—Stephen J. Lechert, Jr.

*Assistant Examiner*—Ngoclan T. Mai

*Attorney, Agent, or Firm*—Andrus, Sceales, Starke & Sawall

[57] ABSTRACT

Method of producing powder-metallurgical objects, specifically elongate objects such as rods, sections, tubes or the like, wherein a powder of metal and/or metal alloys of great hardness, particularly tool steel or high-speed steel powder, is charged into a thin-walled capsule, said capsule is then sealed so as to be airtight, is heated, and subjected to isostatic compression to produce a blank which will then undergo hot-working, specifically extrusion, for the production of the finished product. In a first alternative, the airtight and sealed capsule is initially heated to a temperature higher than 1,000° C. Following through-heating of the capsule, the latter is maintained at an elevated temperature for a prolonged period. Then the capsule is slowly cooled and subjected to cold isostatic compression prior to final shaping. In a second alternative, the capsule is sealed so as to be airtight, and then subjected to an initial cold isostatic compression. Then the pressed blank is heated to a temperature higher than 1,000° C. Following through-heating of the pressed blank, the latter is maintained at an elevated temperature for a prolonged period of time, whereupon it is subjected to hot-working, specifically extrusion, either immediately or after a preceding cooling step.

17 Claims, No Drawings

METHOD OF PRODUCING POWDER-METALLURGICAL OBJECTS, SPECIFICALLY ELONGATE OBJECTS SUCH AS RODS, SECTIONS, TUBES OR THE LIKE

BACKGROUND OF THE PRESENT INVENTION

The present invention relates to a method of producing powder-metallurgical objects, specifically elongate objects such as rods, sections, tubes or the like, wherein a powder of metal/and or metal alloys of great hardness, specifically tool or high-speed steel powder, is charged into a thin-walled capsule, said capsule is then sealed so as to be airtight, is heated and subjected to isostatic pressure so as to produce a blank which will then be hot-worked, particularly extruded, to form the finished product.

Such a method is known, for instance, from the German Patent DE-C-35 30 741. Tests have shown that the known method cannot be employed for the use of tool steel or high-speed steel powder to produce a flawless, specifically crack-free finished product. The reason is to be found in the low plasticity and malleability of the metal powder used which provides for a maximum powder density of 75% of the theoretical value under the common conditions of cold isostatic compression. Due to the hardness of the metal powder here used, the isostatic compression does not allow for a tight bonding between the material of the capsule and the adjoining metal powder, which results in the formation of folds or "wrinkles" in the comparatively soft material of the capsule in the extrusion step. This phenomenon leads to surface cracks and fissures in the finished product which will become apparent after removal of the capsule material.

Knowing the problems described above, experts have proposed, in the Swedish Patent SE-A-442 486, to heat a high-speed steel powder initially to a temperature between 850° C. and 900° C., in a non-oxidizing environment. Then the thus obtained "powder cake" is pulverized again by mechanical means, i.e. by grinding. Then the powder is reheated to a temperature of 850° C. to 900° C. A shaping tool is then used to press the thus pretreated powder into a blank which will be sintered subsequently at a temperature between 1,150° C. and 1,250° C. until the so-called "communicating porosity" in the blank will have been eliminated, which means that a closed-pore blank is produced. This step is followed by a warm isostatic final compression to a density of practically 100% of the theoretical value. It is obvious that this known method of producing powder-metallurgical objects involves a comparatively expensive process which is not suitable anyhow for the production of elongate objects.

The Australian Patent AT-A-377 718 describes a method of manufacturing objects made of tool steel powder, wherein the powder is charged into a capsule, this capsule is sealed so as to be airtight, is then heated, and wherein the airtight and sealed capsule is heated to a temperature between 700° and 1,000° C., the introduction of air into the capsule is permitted again, and the capsule is then heated to a temperature between 1,050° C. and 1,200° C. This known method obviously still requires that the extruded rods be annealed for several hours whereupon they are continuously cooled, initially in steps to a lower temperature and subsequently in ambient air without temperature control. This method, too, is rather expensive and troublesome, while it appears to be problematic to open the capsule again after heating the same to a temperature between 700° C. and 1,000° C. for heating it to an even higher temperature. This method involves an increased risk of oxidation so that the suitability of this method for practical realization well appears doubtful.

SUMMARY OF THE PRESENT INVENTION

The present invention is now based on the problem of providing a method of the type defined by way of introduction, which will allow for an unproblematic and easy production of flawless or crack-less objects, specifically elongate objects, using a powder of metal and/or metal alloys of great hardness, specifically tool steel or high-speed steel powder.

This problem is solved by processing the sealed capsule blank containing a hard powder of metal and/or a metal alloy and heating the sealed blank to a temperature greater than 1,000° C. and preferably in the range of 1,100° C. to 1,200° C. The heating is carried out for a period to through-heat the capsule blank. The heated capsule blank is held at an elevated temperature above 1000° C. for a period greater than the heating period. The capsule blank is subsequently cold worked to obtain the final product.

The inventive measures contribute to the achievement of a powder density better than 75% of the theoretical density, prior to the hot working, specifically extrusion, of the capsule. In spite of this low powder density, the remaining inventive features contribute to a crack-free finished product. The comparatively hard powder is actually rendered "obedient" for hot working, due to the inventive measures. It was a surprise to detect that the inventive method is suitable for the production of acceptable finished products even if the employed powder consists of metal and/or metal alloys whose carbon percentage is as high as up to 2.5% by weight.

In the one method, a cooling time is provided which is noticeably longer than the through-heating time and the time for which the capsule is maintained at an elevated temperature level. The cooling time of the capsule corresponds preferably to some 3 to 5 hours. The capsule may be cooled down to the ambient temperature in the furnace in which it had been heated and maintained at an elevated temperature. This contributes to an extremely "gentle" cooling, i.e. a comparatively low cooling rate without any quenching effect.

The cold isostatic compression of the capsule is expediently realized at a pressure in the range of some 4,500 to 5,500 bar. The metal powder, which has been rendered comparatively easy to manage by the thermal pretreatment, undergoes a compaction in this compression step which is sufficiently strong so as to furnish flawless products in the subsequent hot-working step.

Successful tests have been made with a powder of metal and metal alloys, which present(s) a carbon percentage of at least 0.5% to 2.5%. The mean particle size was roughly 125$\mu$, with a maximum particle size ranging between 600 and 800$\mu$. The length/diameter ratio of the capsule charged with powder was some (4–5):1 in the tests carried through, with capsules being used that had a length between 600 and 1,100 mm while their diameters ranged from 120 to 236 mm.

In an alternative method, which also solves the problem underlying the present invention, it is not always necessary to cool the pressed blank prior to hot-working. Good results can be achieved also when the hot-working step will have commenced immediately after maintaining the pressed blank at an elevated temperature higher than 1,000° C.

In the alternative method the pressed blank should be maintained at an elevated temperature for a prolonged period, preferably for a time as long as 4 to 5 hours.

DESCRIPTION OF THE EMBODIMENTS

In the following, the method according to the present invention will be described in more detail with reference to some comparative examples:

1st Alternative

Example 1

An elongate section was produced for tool steel powder presenting the following composition (expressed in % by weight):

C=0.85; W=6.0; Mo=5.0; Cr=4.0; V=2.0; Fe=-balance, in accordance with the present invention:

The tool steel powder, presenting a mean particle size of 125μ and a maximum particle size of roughly 600μ, was charged into a thin-walled capsule of low-carbon steel, having a diameter of 120 mm and a length or height, respectively, of 600 mm. Then the capsule was sealed and exposed to cold-isostatic compression, at a pressure of roughly 5,000 bar to form a pressed blank. This furnished an appropriate powder density of 75% of the theoretical value.

Then the pressed blank was heated to the hot-working temperature. Subsequently the blank was extruded. The finished product presented unacceptable cracks and fissures and had to be rejected. Even the application of a higher pressure in the cold-isostatic compression step failed to lead to a better result.

Example 2

The tool steel powder from Example 1 was charged, like in Example 1, into a capsule. Then the capsule was sealed so as to be airtight. Subsequently, the capsule was heated to 1,150° C. until the capsule had reached this temperature level all through. Then the capsule was maintained at this level for roughly 1 hour, and was thereupon slowly cooled in the furnace. The cooling down to the ambient temperature lasted for 4 hours. Then the capsule was subjected to cold isostatic compression and extrusion. Due to this cold isostatic compression, a powder density of roughly 80% of the theoretical value was achieved. A higher density was not required, in spite of tool steel powder being used which presents a comparatively high resistance to deformation not only at low but also at high temperatures. In spite of this property of the metal powder employed, the theoretical density was achieved in the finished product. Moreover, the finished product did not show any flaws, i.e. cracks or fissures.

It should be mentioned here that in all of the tests the powder particles presented an approximately spherical shape, or else the metal powder would not have been suited for processing in the aforedescribed manner.

2nd Alternative

Example 3

The capsule charged with tool steel powder according to Example 1, was sealed so as to be airtight and then subjected to cold isostatic compression, achieving a powder density of roughly 75% of the theoretical value. This intermediate blank was then heated to 1,150° C. Following through-heating, the pressed blank was maintained at this temperature for roughly 1 hour and then slowly cooled. The cooling time in the furnace corresponded to 3 hours, approximately. After this treatment, the powder density was roughly 80% of the theoretical density. Then the compressed blank was extruded. The finished product presented the theoretical density and did not show any flaws, specifically cracks or fissures.

In both alternatives of the method, it is thus not necessary to demand a powder density higher than 80% of the theoretical value prior to extrusion of any other hot-working step, in the attempt to produce flawless powder-metallurgical finished products with a density of practically 100% of the theoretical value.

Finally, it should be emphasized that results will be achieved which are the better, the finer or smaller the powder particles are dimensioned. Moreover, it should be noted that with the application of the aforedescribed method the carbon percentage in the metal powder is not particularly critical, which means that even high-carbon metal powders may be processed in such a powder-metallurgical method to furnish acceptable and flawless finished products.

I claim:

1. Method of producing powder-metallurgical objects, specifically elongate objects such as rods, sections, tubes or the like, wherein a powder of metal and/or metal alloys of great hardness, such as a tool or high-speed steel powder, is charged into a thin-walled capsule, said capsule is then sealed so as to be airtight to produce a blank which is to be extruded or otherwise hot-worked to form the finished product, comprising the steps following the airtight sealing of the capsule:

(a) heating the airtight sealed blank to an elevated temperature higher than 1,000° C. until the capsule and powder is at the elevated temperature in the range from 1,100° C. to 1,200° C.;

(b) maintaining the capsule at said elevated temperature for a defined length of time which is longer than said heating interval to heat the capsule and powder;

(c) slowly cooling the capsule, and (d) after said cooling and prior to subjecting the capsule to hot-working, cold isostatic compressing said capsule to achieve a powder density higher than 75% of the theoretical density.

2. The method of claim 1 wherein said powder density is in the range of 78% to 80%.

3. The method according to claim 1 wherein said period of slowly cooking the capsule is substantially longer than the heating time and maintaining time, and said cooling time generally is in the range double to fourfold of the sum of the two times.

4. The method according to claim 1 wherein said capsule is maintained at said elevated temperature for a range of 1 to 2 hours, and said cooling time is generally in the range of 3 to 5 hours.

5. The method of claim 1 wherein said capsule is located within a furnace during said heating and maintaining of said elevated temperature, turning said furnace off after said maintaining period, and holding said capsule in said furnace for a sufficient period to cool the capsule to ambient temperature in the furnace.

6. The method of claim 1, characterized in that the cold-isostatic compression takes place at a pressure of about 4,500 to 5,500 bar.

7. The method of claim 1 wherein said powder includes a carbon percentage in the range of at least to 0.5% by weight.

8. The method of claim 7 wherein said carbon is in the range of 1.1% to 2.5% by weight.

9. The method of claim 1 wherein said powder has a mean particle size which corresponds generally to at least 125μ and includes a maximum particle size not exceeding 800μ.

10. The method of claim 1 wherein said charged capsule has a length/diameter ratio corresponding to the approximate range of 4–5:1.

11. A method of producing powder-metallurgical objects, including elongate objects such as rods, sections, tubes or the like, wherein a powder of metal and/or metal alloys of great hardness such as tool steel or high-speed steel powder is charged into a thin-walled capsule, the capsule is then sealed so as to be airtight to produce a blank which will subsequentially be hot-worked such as extruded to form the finished product, comprising the processing steps applied to the airtight capsule of:

(a) subjecting the sealed blank to cold isostatic compression and establishing a powder density in the range of substantially 70 to 75% of the theoretical density;

(b) heating the compressed blank for a time period to heat the blank to a temperature higher than 1,000° C.;

(c) maintaining said heated pressed blank at a temperature greater than 1,000° C. for a defined period longer than said time period, and (d) subsequently hot working the pressed blank immediately without cooling.

12. The method of claim 11 wherein said blank is heated to a range of 1,100° C. to 1,200° C.

13. The method of claim 11 wherein said cold-isostatic compression includes a pressure in the range from approximately 4,500 to 5,500 bar.

14. The method of claim 11 including said period of maintaining the through-heated pressed blank at the elevated temperature equal to at least in the range of 1 hour to roughly 4 hours.

15. The method of claim 11 wherein said powder has a carbon constant of at least 0.5% by weight and less than 2.5% by weight.

16. The method of claim 11 wherein said powder has a mean particle size of about 125μ and includes a maximum particle size not exceeding 800μ.

17. The method of claim 11 wherein said capsule has length/diameter ratio corresponds approximately to the range of 4 to 5:1.

* * * * *

UNITED STATES PATENT AND TRADEMARK OFFICE

CERTIFICATE OF CORRECTION

PATENT NO. : 4,923,671

DATED : May 8, 1990

INVENTOR(S) : CHRISTER ASLUND

It is certified that error appears in the above-identified patent and that said Letters Patent is hereby corrected as shown below:

On the title page;

In the title, after "SECTIONS" delete "TUBES";

In the claims, Claim 3, column 4, line 52, delete "cooking" and substitute therefor -- cooling --.

Signed and Sealed this

Twenty-sixth Day of May, 1992

*Attest:*

DOUGLAS B. COMER

*Attesting Officer*

*Acting Commissioner of Patents and Trademarks*